US010130926B2

(12) United States Patent
Vogt

(10) Patent No.: US 10,130,926 B2
(45) Date of Patent: Nov. 20, 2018

(54) VACUUM MIXING SYSTEM AND METHOD FOR THE MIXING OF POLYMETHYLMETHACRYLATE BONE CEMENT

(71) Applicant: HERAEUS MEDICAL GMBH, Wehrheim (DE)

(72) Inventor: Sebastian Vogt, Erfurt (DE)

(73) Assignee: HERAEUS MEDICAL GMBH, Wehrheim (DE)

( * ) Notice: Subject to any disclaimer, the term of this patent is extended or adjusted under 35 U.S.C. 154(b) by 448 days.

(21) Appl. No.: 14/734,157

(22) Filed: Jun. 9, 2015

(65) Prior Publication Data

US 2015/0367301 A1 Dec. 24, 2015

(30) Foreign Application Priority Data

Jun. 18, 2014 (DE) ..... 10 2014 108 569

(51) Int. Cl.
*B01F 13/00* (2006.01)
*B01F 13/06* (2006.01)
(Continued)

(52) U.S. Cl.
CPC ..... *B01F 13/065* (2013.01); *B01F 3/1214* (2013.01); *B01F 3/1271* (2013.01);
(Continued)

(58) Field of Classification Search
CPC ..... B01F 3/1214; B01F 13/0023; B01F 13/0033; B01F 13/06; B01F 13/065;
(Continued)

(56) References Cited

U.S. PATENT DOCUMENTS 4,671,263 A 6/1987 Draenert
4,758,096 A 7/1988 Gunnarsson
(Continued)

FOREIGN PATENT DOCUMENTS

DE 36 40 279 A1 6/1987
DE 698 12 726 T2 2/2004
(Continued)

OTHER PUBLICATIONS

JP Office Action and English Translation of Office Action dated Jun. 7, 2016.

(Continued)

*Primary Examiner* — Anshu Bhatia
(74) *Attorney, Agent, or Firm* — Norris McLaughlin P.A.

(57) ABSTRACT

A vacuum mixing system for the mixing of polymethylmethacrylate bone cement, comprising at least one cartridge (4) having an evacuable internal space for mixing of the bone cement, a pump (18) for generating a negative pressure, and a connecting conduit (12) connecting the internal space of the at least one cartridge (4) to the pump (18) for generating a negative pressure, an integrated energy reservoir (28) for driving the pump (18) that is or can be connected to the pump (18) and has energy for at least one pumping process of the pump (18) stored in it, whereby a negative pressure can be generated by means of the pump (18) during the pumping process, which negative pressure can be used to evacuate gas from the internal space of the at least one cartridge (4) through the connecting conduit (12).

19 Claims, 4 Drawing Sheets

(51) Int. Cl.

| | |
|---|---|
| ***B01F 11/00*** | (2006.01) |
| ***B01F 15/02*** | (2006.01) |
| ***F04B 33/00*** | (2006.01) |
| ***B01F 3/12*** | (2006.01) |

(52) U.S. Cl.
CPC ..... *B01F 11/0082* (2013.01); *B01F 13/0023* (2013.01); *B01F 13/0033* (2013.01); *B01F 13/06* (2013.01); *B01F 15/0201* (2013.01); *B01F 15/0206* (2013.01); *B01F 15/0258* (2013.01); *B01F 15/0278* (2013.01); *B01F 15/0279* (2013.01); *F04B 33/00* (2013.01); *B01F 2215/0029* (2013.01)

(58) Field of Classification Search
CPC ..... B01F 3/1271; B01F 11/0082; B01F 15/0201; B01F 15/0206; B01F 15/0258; B01F 15/0278; B01F 15/0279; B01F 2215/0029; F04B 33/00
See application file for complete search history.

(56) References Cited

U.S. PATENT DOCUMENTS

| | | | | |
|---|---|---|---|---|
| 4,973,168 | A | 11/1990 | Chan | |
| 5,100,241 | A | 3/1992 | Chan | |
| 5,344,232 | A | 9/1994 | Nelson et al. | |
| 5,551,778 | A | 9/1996 | Hauke et al. | |
| 5,571,282 | A | 11/1996 | Earle | |
| 5,586,821 | A | 12/1996 | Bonitati et al. | |
| 5,588,745 | A | 12/1996 | Tanaka et al. | |
| 5,624,184 | A | 4/1997 | Chan | |
| 5,997,544 | A | 12/1999 | Nies et al. | |
| 6,033,105 | A | 3/2000 | Barker et al. | |
| 6,533,937 | B1 | 3/2003 | Burchett | |
| 6,536,937 | B1 | 3/2003 | Burchett | |
| 6,709,149 | B1 | 3/2004 | Tepic | |
| 6,836,937 | B1 | 1/2005 | Boscolo | |
| 2010/0329074 | A1* | 12/2010 | Vogt | A61B 17/8825 366/190 |
| 2013/0115111 | A1* | 5/2013 | Wust | A61B 17/8822 417/55 |

FOREIGN PATENT DOCUMENTS

| | | | |
|---|---|---|---|
| DE | 10 2009 031 178 | B3 | 9/2010 |
| EP | 0 692 229 | A1 | 1/1996 |
| EP | 1 005 901 | A2 | 6/2000 |
| EP | 1 016 452 | A2 | 7/2000 |
| EP | 1 020 167 | A2 | 7/2000 |
| EP | 1 886 647 | A1 | 2/2008 |
| EP | 2 589 821 | A1 | 5/2013 |
| JP | 1999-507295 | A | 6/1999 |
| JP | 2011005255 | A | 1/2011 |
| JP | 2013-135833 | A | 7/2013 |
| WO | 94/26403 | A1 | 11/1994 |
| WO | 99/67015 | A1 | 12/1999 |

OTHER PUBLICATIONS

Chinese Office Action corresponding to Chinese Application No. 201510339552, dated Feb. 14, 2017.
German Office Action dated Feb. 2, 2015.
Australian Examination Report dated Mar. 10, 2016.

* cited by examiner

VACUUM MIXING SYSTEM AND METHOD FOR THE MIXING OF POLYMETHYLMETHACRYLATE BONE CEMENT

The invention relates to a vacuum mixing system for the mixing of polymethylmethacrylate bone cement (PMMA bone cement) from two starting components, in particular for the mixing of a medical bone cement, and for storage of the starting components.

The invention further relates to a method for the mixing of polymethylmethacrylate bone cement.

Accordingly, the subject matter of the invention is a vacuum mixing system for the storage, mixing, and, if applicable, dispensing of polymethylmethacrylate bone cement. The invention further relates to a method for the transferring of monomer liquid into the vacuum mixing system and to a method for the mixing of the components of polymethylmethacrylate bone cement.

BACKGROUND OF THE INVENTION

Polymethylmethacrylate (PMMA) bone cements are based on the pioneering work of Sir Charnley. PMMA bone cements consist of a liquid monomer component and a powder component. The monomer component generally contains the monomer, methylmethacrylate, and an activator (N,N-dimethyl-p-toluidine) dissolved therein. The powder component, which is also referred to as bone cement powder, comprises one or more polymers, a radiopaquer, and the initiator dibenzoylperoxide. The polymers of the powder component are produced on the basis of methylmethacrylate and comonomers, such as styrene, methylacrylate or similar monomers by means of polymerisation, preferably by suspension polymerisation. During the mixing of powder component and monomer component, swelling of the polymers of the powder component in the methylmethacrylate generates a dough that can be shaped plastically and is the actual bone cement. During the mixing of powder component and monomer component, the activator, N,N-dimethyl-p-toluidine, reacts with dibenzoylperoxide while forming radicals. The radicals thus formed trigger the radical polymerisation of the methylmethacrylate. Upon advancing polymerisation of the methylmethacrylate, the viscosity of the cement dough increases until the cement dough solidifies.

Methylmethacrylate is the monomer used most commonly in polymethylmethacrylate bone cements. Redox initiator systems usually consist of peroxides, accelerators and, if applicable, suitable reducing agents. Radicals are formed only if all ingredients of the redox initiator systems act in concert. For this reason, the ingredients of the redox initiator system in the separate starting components are arranged appropriately such that these cannot trigger a radical polymerisation. The starting components are stable during storage provided their composition is adequate. Only when the two starting components are mixed to produce a cement dough, the ingredients of the redox initiator system, previously stored separately in the two pastes, liquids or powders react with each other forming radicals which trigger the radical polymerisation of the at least one monomer. The radical polymerisation then leads to the formation of polymers while consuming the monomer, whereby the cement dough is cured.

PMMA bone cements can be mixed by mixing the cement powder and the monomer liquid in suitable mixing beakers with the aid of spatulas. One disadvantage of said procedure is that air inclusions may be present in the cement dough thus formed and can cause destabilisation of the bone cement later on. For this reason, it is preferred to mix bone cement powder and monomer liquid in vacuum mixing systems, since mixing in a vacuum removes air inclusions from the cement dough to a large extent and thus achieves optimal cement quality. Bone cements mixed in a vacuum have clearly reduced porosity and thus show improved mechanical properties. A large number of vacuum cementing systems have been disclosed of which the following shall be listed for exemplary purposes: U.S. Pat. No. 6,033,105 A, U.S. Pat. No. 5,624,184 A, U.S. Pat. No. 4,671,263 A, U.S. Pat. No. 4,973,168 A, U.S. Pat. No. 5,100,241 A, WO 99/67015 A1, EP 1 020 167 A2, U.S. Pat. No. 5,586,821 A, EP 1 016 452 A2, DE 36 40 279 A1, WO 94/26403 A1, EP 1 005 901 A2, U.S. Pat. No. 5,344,232 A. In the vacuum cementing systems thus specified, there is a need to connect an external vacuum pump to generate the negative pressure. These are generally operated by compressed air utilising the Venturi principle. The compressed air required for operation of the vacuum pumps is supplied either by stationary compressed air facilities or by electrically-operated compressors. In addition, it is also feasible to use electrically-operated vacuum pumps to generate vacuum.

Cementing systems, in which both the cement powder and the monomer liquid are already packed in separate compartments of the mixing systems and are mixed with each other in the cementing system only right before application of the cement, are a development of cementing technology. Said full-prepacked mixing systems were proposed through EP 0 692 229 A1, DE 10 2009 031 178 B3, U.S. Pat. No. 5,997,544 A, U.S. Pat. No. 6,709,149 B1, DE 698 12 726 T2, and U.S. Pat. No. 5,588,745 A. Said mixing systems also require an external vacuum source. In this context, the DE 10 2009 031 178 B3 patent discloses a generic vacuum mixing device having a two-part dispensing plunger that can also be used for a vacuum mixing device according to the invention.

If vacuum mixing systems are used for cementing, external vacuum pumps need to be provided. Said vacuum pumps are expensive and need to be cleaned after use. Moreover, vacuum hoses for connecting the vacuum pumps to the vacuum mixing systems are required. Said vacuum hoses need to be enclosed with the vacuum mixing systems. Accordingly, prior to the mixing using a vacuum mixing system, the vacuum pump needs to be set-up in the surgical theatre (OR) and must be connected to an energy source, such as compressed air or electrical power. Then, the vacuum pump is connected to the vacuum mixing system by means of a vacuum hose. Said installation steps take up costly OR time and are potentially error-prone. The vacuum pump and connecting conduits to the vacuum mixing system and to external energy sources and supply conduits take up space and are potential tripping hazards and stumbling blocks that can disturb the often hectic procedure during a surgery.

An interesting concept has been proposed through EP 1 886 647 A1. Here, the cement powder is stored in an evacuated cartridge and the monomer liquid is situated in a separate container. The cartridge, which is kept at a negative pressure, being opened causes the monomer liquid to be aspirated into the cartridge without any ingress of air. A bone cement dough free of air inclusions is thus produced. Said concept requires the cartridge to remain closed in vacuum-tight manner during the storage before use such that no non-sterile air can enter into the cartridge. For this purpose, the cartridge must be sealed in a stable hermetic manner. Accordingly, one associated disadvantage is that the design is quite elaborate and that the content of the cartridge cannot be mixed by an externally-operated mixing system after aspiration of the monomer since a feed-through for a mixing rod or for a mixing tube would not readily be permanently vacuum-tight.

Accordingly, it is the object of the invention to overcome the disadvantages of the prior art. Specifically, the disadvantages of the known vacuum mixing systems having an external vacuum source are to be overcome. It is the object of the invention, specifically, to develop a vacuum mixing system, in which a negative pressure is generated only just before the cement components are being mixed. The device is to be as simple as possible and shall allow a negative pressure with respect to the surrounding atmosphere to be generated, at least once, in a cement cartridge. Moreover, it can be advantageous that the vacuum mixing system is capable of enabling a transfer of monomer liquid from a monomer container into a cartridge filled with cement powder. Moreover, a method is then to be provided that enables a monomer transfer and a vacuum mixing in full-prepacked mixing systems. Moreover, the vacuum mixing system to be developed shall be manufactured mainly from inexpensive plastics.

Moreover, a device that is inexpensive to manufacture and working reliably for the mixing of a medical cement and, if applicable, for storage of the starting components, and a method for the mixing of the bone cement is to be devised, in which a simple manual operation can be used to mix the starting components, if possible without having to use an external or additional energy source and without air inclusions arising in the mixing material.

The main component of the polymethylmethacrylate bone cement, as mixing material, shall be a powder and the second component shall be present in the form of a liquid. Preferably, it shall be possible to store the two starting components of the bone cement separate from each other in the vacuum mixing system and to combine them safely through the use of the device.

SUMMARY OF THE INVENTION

The objects of the invention are met by a vacuum mixing system for the mixing of polymethylmethacrylate bone cement, comprising at least one cartridge having an evacuable internal space for mixing of the bone cement, a pump for generating a negative pressure, and a connecting conduit connecting the internal space of the at least one cartridge to the pump for generating a negative pressure, whereby the vacuum mixing system comprises an integrated energy reservoir for driving the pump that is or can be connected to the pump and has energy for at least one pumping process of the pump stored in it, whereby a negative pressure can be generated by means of the pump during the pumping process by consuming energy from the integrated energy reservoir such that the negative pressure can be used to evacuate gas from the internal space of the at least one cartridge through the connecting conduit.

Presently, negative pressure shall be understood to mean a pressure related to the ambient atmosphere that is less than the ambient atmospheric pressure.

Preferably, the pump can be provided to be integrated into the vacuum mixing system.

Preferably, the polymethylmethacrylate bone cement is mixed and/or can be produced from at least two components. Particularly preferably, one component is liquid and the other component is powdered.

Preferably, the invention can provide the pressure in the internal space of the at least one cartridge to be reducible by at least 50%, preferably to be reducible by at least 90%, by the pumping process.

DETAILED DESCRIPTION

According to the invention, the starting components for the mixing material, in particular for the PMMA bone cement, are already present in the cartridges.

It is preferred, according to the invention, that the device is also well-suited for storage of the starting components, in particular when the containers are inserted into the device or the containers are a fixed part of the device.

The mixing material is particularly preferred to be a bone cement, in particular a PMMA bone cement.

A refinement of the invention can just as well provide that gas can be evacuated through the connecting conduit from the internal space of the at least one cartridge by the negative pressure and that gas can be evacuated from a conduit between the internal space and a liquid container by the negative pressure and that a liquid to be mixed with a first component of the PMMA bone cement in the cartridge can be drawn from the liquid container into the internal space of the cartridge by the negative pressure.

A refinement of the vacuum mixing system proposes that the pump comprises a gas-tight pumping space and that a mobile plunger or a mobile wall is provided in the pump to serve as boundary of the pumping space, whereby the plunger or wall can be driven in one direction, preferably unidirectionally, by the energy of the integrated energy reservoir such that the motion of the plunger or wall enlarges the pumping space and the negative pressure thus arising in the pumping space allows the internal space of the at least one cartridge to be evacuated through the connecting conduit.

Alternatively, the invention can just as well provide the pump to comprise a rotating wheel, a periodically working plunger or a periodically working membrane. However, the embodiment having a mobile plunger or a mobile wall is preferred according to the invention since its design is markedly simpler, less error-prone (rotating parts might get blocked), and thus less expensive, while already being sufficient for briefly generating a negative pressure in the internal space of the cartridge. Due to the specific requirements, such as the volume of the internal space of the cartridge being small, there is no need to have more elaborate pump systems present.

Said embodiment can also provide the volume enlargement of the pumping space to be at least equal to the free volume of the internal space of the cartridge, preferably the volume enlargement of the pumping space to be at least equal to the sum of the volume of the internal space of the cartridge containing a first powdered component of the PMMA bone cement and the volume of the connecting conduit and the volume of a conduit between the internal space and a liquid container and the volume of a liquid in the liquid container to be mixed in the cartridge with the first component of the PMMA bone cement, whereby the liquid is a second component of the PMMA bone cement.

This ensures that the pump can evacuate the internal space of the cartridge. In this context, the volume of the pumping space prior to the pumping process is as small as possible in an ideal case. Accordingly, the invention can preferably provide the volume of the pumping space after the pumping process to be at least 5 times larger than the volume of the pumping space before the pumping process, particularly preferably to be at least 10 times larger than the volume of the pumping space before the pumping process.

According to a refinement, the present invention can provide the vacuum mixing system to comprise a mixing device for the mixing of the content of the at least one cartridge, whereby the mixing device is preferred to be arranged in the internal space of the cartridge and/or can be driven manually or through a motor.

Preferably, the cartridge comprises a pressure-tight feed-through through which a rod or a mixing tube is guided by means of which the mixing device can be operated from outside the cartridge. For this purpose, the rod or the mixing tube is preferred to be mounted appropriately in the feed-through such that it can rotate and be shifted in longitudinal direction. The mixing device can be used to mix the cartridge content well.

Moreover, the invention can provide the total weight of the vacuum mixing system to be less than 30 kg, particularly preferably the total weight to be less than 10 kg.

The design, according to the invention, of the mixing device having an integrated energy reservoir and of the pump enables the weights to be as low as specified. The weight being low is advantageous in that the mixing device can be taken along and can be used without any connection to supply conduits and without major preparation in advance.

A vacuum mixing system that is particularly easy to use can be implemented by providing the vacuum mixing system to comprise a manually-operable operating element that can be operated to release the energy from the energy reservoir, whereby the released energy drives the pump and the driven pump evacuates the internal space of the cartridge.

This simplifies the operation of the vacuum mixing system. As a result, the operation can be ensured to be simple despite the compact design.

According to a preferred embodiment, the invention can provide the energy reservoir to be a filled gas pressure cartridge, preferably a $CO_2$ gas cartridge, or a tensioned restoring element, preferably a tensioned spring, particularly preferably a tensioned steel spring.

Said energy reservoirs keep the energy even over extended periods of time. Moreover, the small amount of energy thus stored is sufficient to ensure a sufficient negative pressure for evacuation of the internal space of the cartridge.

Other energy reservoirs that are feasible and can be used according to the invention include batteries, rechargeable batteries or capacitors by means of which a short-term pulse can be elicited, for example by means of an electromagnetic interaction, to drive the pump. Likewise, a chemical propellant could serve as energy reservoir to drive the pump. However, said energy reservoirs are significantly more elaborate and difficult to implement than gas pressure cartridges and, in particular, than restoring elements such as springs. For this reason, gas pressure cartridges and tensioned restoring elements, such as springs, are particularly preferred according to the invention.

Moreover, the invention proposes a mobile dispensing plunger for dispensing the mixed bone cement from the cartridge to be arranged in the internal space of the cartridge, whereby the dispensing plunger preferably is or can be locked in place in detachable manner in order to prevent the dispensing plunger from moving in response to the effect of the negative pressure.

The dispensing plunger simplifies the operation of the vacuum mixing system.

Moreover, the invention can provide the pump to be be driven by a tensioned restoring element, in particular a tensioned spring element, whereby, preferably, an expansion or contraction of the restoring element, in particular of the spring element, generates a negative pressure in the internal space of the cartridge with respect to the ambient atmosphere.

This design is particularly simple and inexpensive to implement. However, at the same time said design allows a reliably working vacuum mixing system to be designed that is relatively non-susceptible to failure.

According to a refinement, the invention can provide the cartridge to be a cement cartridge filled with cement powder and the vacuum mixing system to comprise a container that is separate from the cement cartridge and contains a monomer liquid, whereby the container is connected, in liquid-impermeable manner, to the internal space of the cement cartridge through a separating element that can be opened, and the internal space of the cement cartridge is or can be connected to the pump in gas-permeable manner.

A particularly preferred embodiment of the invention can provide the pump to be designed to comprise:

A) a hollow cylinder, whereby the hollow cylinder is or can be connected to the internal space of the cartridge;

B) a gas-tight closure on one end of the hollow cylinder;

C) a plunger that is arranged in the hollow cylinder such as to be gas-tight and axially mobile;

D) at least one spring element as integrated energy reservoir that is arranged between the plunger and the closure;

E) a connecting element that is connected, in detachable manner, to the plunger and keeps the plunger in position in the hollow cylinder and keeps the spring element tensioned or compressed, whereby the connecting element is guided out of the hollow cylinder through a gas-tight feed-through and can be detached from the plunger from outside, whereby, after detaching the connection of the connecting element, the plunger can be moved axially opposite to the closure by the expansion of the spring element.

Said design is particularly simple and the parts for it can be manufactured from plastics by injection moulding.

In this embodiment, the invention can provide the spring element to be compressed in the storage state and to be kept in the compressed state by the plunger of the pump by means of the locked connecting element.

Moreover, in this context, the invention can provide the plunger to be shifted appropriately inside the hollow cylinder after expansion of the spring element such that the volume of the pumping space formed by the hollow cylinder, the closure, and the plunger is at least equal to the volume of the internal space of the cartridge to be evacuated.

The effect of matching the volumes is that the pump is dimensioned to be sufficient for the specified purpose.

Moreover, the invention can provide a boundary element to be arranged on the end of the hollow cylinder and to limit the motion of the plunger appropriately such that the plunger cannot exit from the hollow cylinder.

According to a refinement, the invention can provide the plunger to contain, on the side facing away from the closure, an optical marker that can be recognised visually on the outside of the vacuum mixing system after a maximal motion of the plunger took place and thus indicates the position of the plunger after its maximal motion.

As a result, the user can recognise the state of the vacuum mixing system from outside.

The underlying objects of the present invention are also met by a method for the mixing of polymethylmethacrylate bone cement in an internal space of a cartridge of a vacuum mixing system, in particular of a vacuum mixing system according to the invention, in which energy stored in an energy reservoir that is integrated into the vacuum mixing system is used to drive a pump of the vacuum mixing system, whereby the pump thus driven is used to evacuate the internal space of the cartridge and to mix a bone cement in the internal space of the cartridge.

In this context, the invention can provide the volume of a pumping space of the pump to become enlarged by relaxation of a restoring element serving as integrated energy reservoir, and the internal space of the cartridge to be evacuated by the negative pressure thus generated.

A refinement can provide the internal space of the cartridge to contain a cement powder, and the pump to evacuate a gas from the internal space of the cartridge, a monomer liquid to be guided into the internal space of the cartridge, and the monomer liquid to be mixed with the cement powder in the evacuated internal space.

In this context, the invention can provide a connecting element to be detached from a plunger of the pump, followed by a compressed restoring element moving the plunger axially in a hollow cylinder of the pump, by means of which a negative pressure with respect to the ambient atmosphere is generated, whereby gas is aspirated from the internal space of the cartridge through a connecting conduit into the hollow cylinder, followed by a cement powder being mixed, manually or motor-driven, with a monomer liquid by means of a mixing device, followed by the cartridge with the mixed cement dough being removed and the cement dough being extruded from the cartridge by moving a dispensing plunger axially.

Moreover, the invention can provide the cement powder to be arranged in the cartridge, the monomer liquid to be arranged in a container that is separate from the cartridge, whereby the monomer liquid is separated from the cement powder in the cartridge by means of a separating element, the separating element to be opened before the connecting element is being detached from the plunger such that a liquid-permeable connection is established between the internal space of the cartridge and the container, followed by the compressed spring element moving the plunger axially in the hollow cylinder, whereby a negative pressure with respect to the ambient atmosphere is generated, whereby gas is aspirated from the internal space of the cartridge through the connecting conduit into the hollow cylinder, and monomer liquid is aspirated into the cartridge through the negative pressure formed in the internal space of the cartridge.

The invention is based on the surprising finding that having a pump and an integrated energy reservoir, in which a sufficient amount of energy is stored for the pump to evacuate the internal space of the cartridge allows a vacuum mixing system to be provided that is independent of external energy sources and other supply conduits. The vacuum mixing system according to the invention can be designed to be compact, lightweight, and space-saving. The pump can be designed to include the easiest means such that the entire vacuum mixing system can be used as a single-use system. Moreover, and preferred according to the invention, the energy can also be used to transfer a monomer liquid into the cement powder by means of the pump. The two components of the PMMA bone cement can then be mixed in a vacuum and/or at the negative pressure.

It is another advantage of the vacuum mixing system according to the invention that the gases evacuated from the cartridge are not released to the surroundings since there is then no need to filter these gases in order to remove undesired ingredients (such as, for example, methylmethacrylate vapours). Instead, the gases simply remain inside the pump and/or in the pumping space.

Cementing systems according to the present invention contain a device for generating a vacuum and/or for generating a negative pressure that is suitable for temporary generation of a negative pressure before and during the mixing of a powdered component with a liquid monomer component of the polymethylmethacrylate bone cement.

The underlying rationale of the invention is based on finding that only a relatively small amount of energy is required to generate the vacuum and/or the negative pressure in a cartridge required for mixing the starting components of a bone cement at said negative pressure or vacuum. The amount of energy required to transfer the monomer liquid into the cement powder is also small. Said small amount of energy, by means of which the pump is driven, can be stored in an internal energy reservoir of the vacuum mixing system. Even the amount of energy stored in a tensioned steel spring or another restoring element is sufficient, according to the invention, to provide the energy to drive a vacuum mixing system according to the invention.

BRIEF DESCRIPTION OF THE DRAWINGS

Further exemplary embodiments of the invention shall be illustrated in the following on the basis of four schematic figures, though without limiting the scope of the invention. In the figures:

FIGS. 1 to 3 show a schematic cross-sectional view of a vacuum mixing system according to the invention prior to the pumping process. The vacuum mixing system essentially consists of three parts, a cartridge system 1, a liquid container 2, and a foot part 3. In this context, the cartridge system 1 is connected to the liquid container 2 via the foot part 3. In this context, the foot part 3 forms, inter alia, the base of the compact vacuum mixing system.

Figure 1:
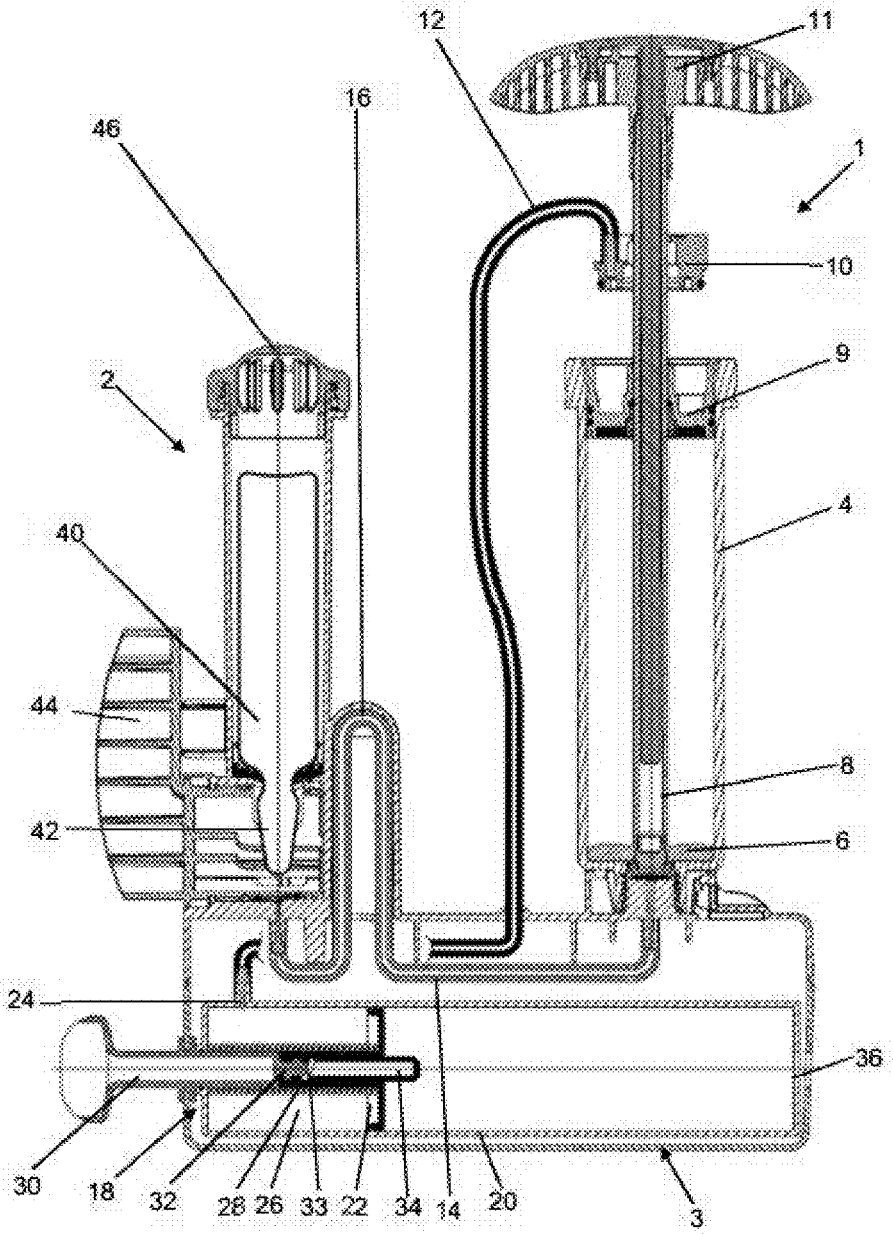
FIG. 1: shows a schematic cross-sectional view of a vacuum mixing system according to the invention in the sterilisation state prior to the pumping process.

The cartridge system 1 comprises a cylindrical cartridge 4 having a circular base surface that is fastened perpendicularly to the foot part 3. For this purpose, an opening having an internal thread is provided on the front side of the cartridge 4 that is screwed onto a socket on the foot part 3, which has an external thread. A cement powder (not shown) is present on the inside of the cartridge 4. Moreover, a mixing device having two or more mixing vanes 6 that are fastened on a mixing tube 8 is arranged on the inside of the cartridge 4. The mixing tube 8 is guided through a sterilisation plunger 9 such that it can be rotated and shifted in longitudinal direction. For this purpose, the feed-through is pressure-tight and gas-tight. The sterilisation plunger 9 comprises a membrane (not shown) that is permeable for a sterilising gas, but impermeable for the cement powder. The sterilisation plunger 9 is inserted into the cartridge 4 after the cement powder is filled in and closes the internal space of the cartridge 4 with respect to the outside. Subsequently, the content of the cartridge 4 can be sterilised through the permeable membrane using ethylene dioxide.

A sealing plunger 10 can be pushed into the sterilisation plunger 9 and can be connected to same in gas-tight and pressure-tight manner. The plungers 9, 10, which are fastened to each other, then together form a dispensing plunger 9, 10 by means of which the content of the cartridge 4 can be extruded through the floor-side opening. However, the sterilisation plunger 9 is initially locked on the opposite side (on the top in FIGS. 1 to 3), whereby the locking can be detached.

A handle part 11 is attached on the mixing tube 8 outside the cartridge 4 by means of which the mixing vanes 6 on the inside of the cartridge 4, i.e. in the internal space of the cartridge 4, can be manually rotated and shifted in the longitudinal direction of the cartridge 4.

A feed-through that is connected to a connecting conduit 12 in the form of a flexible vacuum conduit 12 is provided in the sealing plunger 10. Apart from this, the sealing plunger 10 is tight. The front side of the cartridge 4 (on the bottom in FIGS. 1 to 3) is connected in pressure-tight manner to the liquid container 2 through the foot part 3 via a liquid conduit 14. A siphon 16 is provided in the liquid conduit 14 and is used to prevent a monomer (not shown) contained in the liquid container 2 from inadvertently advancing into the cartridge 4. The vacuum conduit 12 is also guided into the foot part 3 and is guided in the foot part 3 up to a pump 18 such that the feed-through in the sealing plunger 10 is connected in pressure-tight manner to the pump 18, to the internal space of the pump 18 to be specific, via the vacuum conduit 12.

Figure 2:
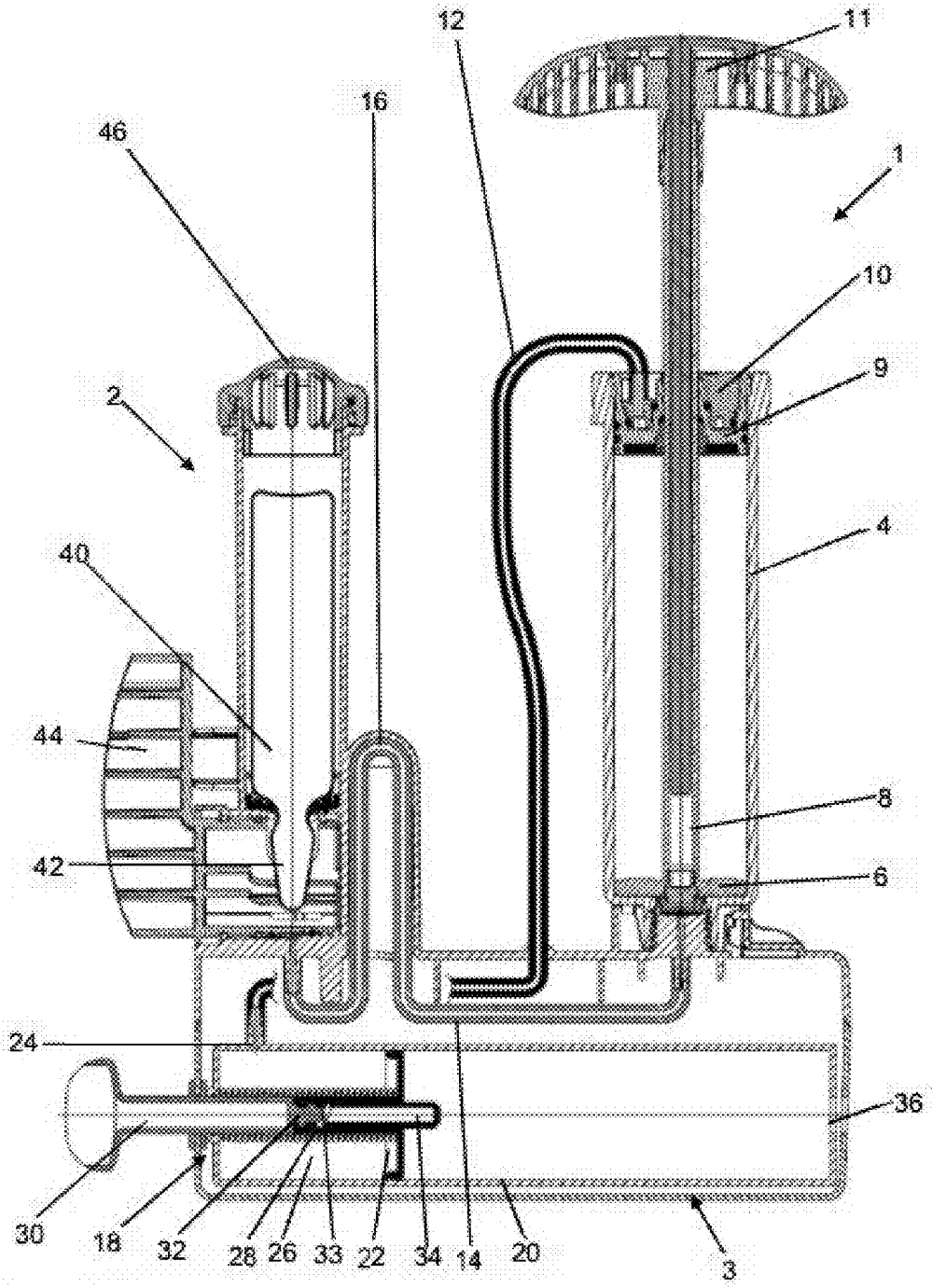
FIG. 2: shows the vacuum mixing system according to FIG. 1 with closed two-part plunger system ready for evacuation of the cartridge.
Figure 3:
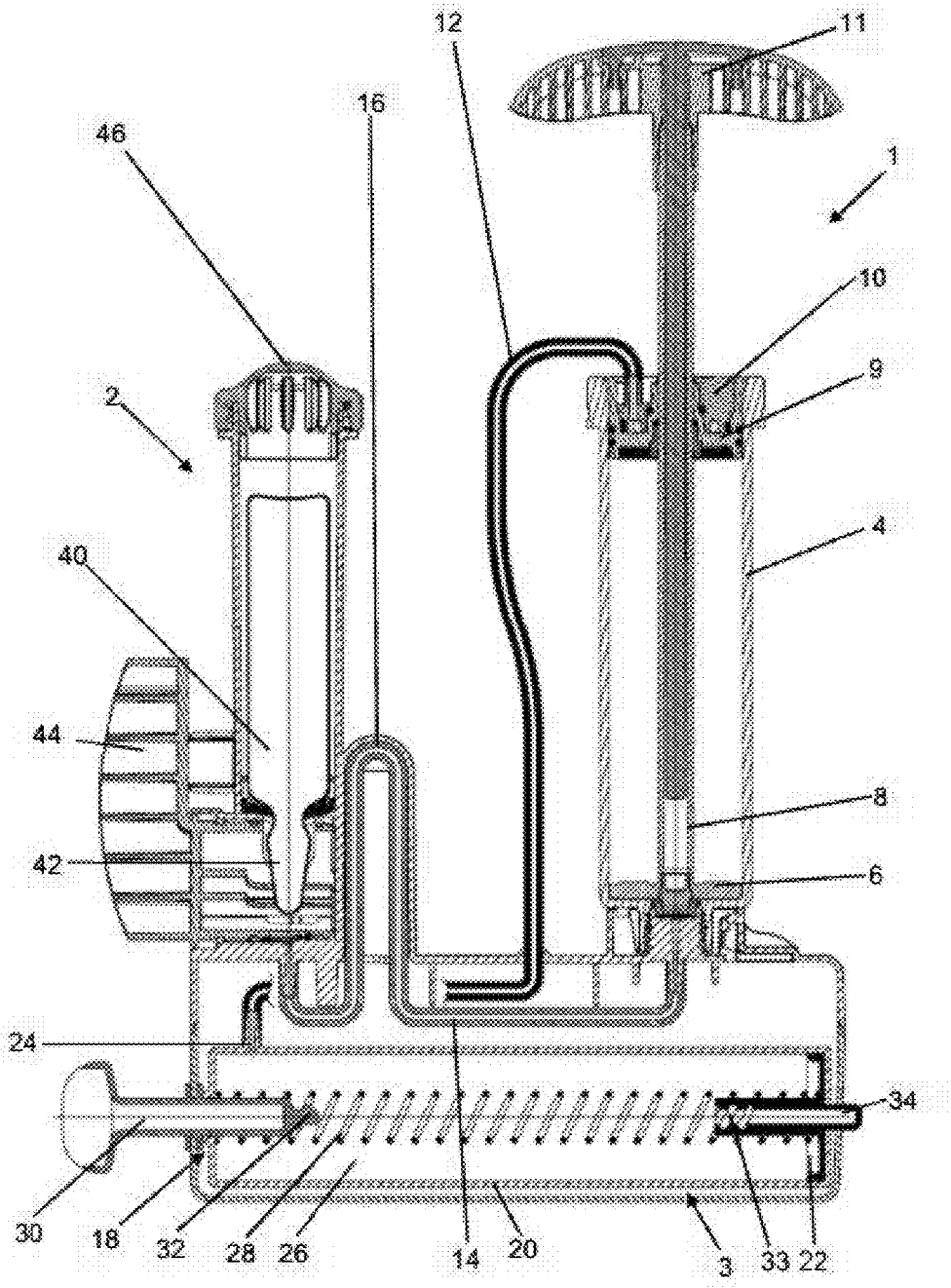
FIG. 3: shows the vacuum mixing system according to FIGS. 1 and 2 with triggered pump and evacuated cartridge after the pumping process.

The pump 18 comprises a stable hollow cylinder 20 that is separated into two parts in pressure-tight manner by means of a plunger 22. An outlet and/or a connector 24 for the vacuum conduit 12 is provided in the rear part (on the left in FIGS. 1 to 3) of the internal space in the hollow cylinder 20. This part of the internal space the hollow cylinder 20 forms a pumping space 26. A negative pressure in the pumping space 26 can thus act through the vacuum conduit 12 up into the internal space of the cartridge 4 and/or a gas can be evacuated from the internal space the cartridge 4 when the sealing plunger 10 is connected to the sterilisation plunger 9 as shown in FIGS. 2 and 3.

The vacuum mixing system is characterised by a tensioned steel spring 28 that is arranged in the pumping space 26 about a screw 30 and about a cylindrical extension on the plunger 22. The screw 30 is guided, in gas-tight and pressure-tight manner and rotatably, through a feed-through into the pumping space 26. For this purpose, the screw 30 forms a closure of the pumping space 26 and/or of the internal space of the hollow cylinder 20. By this means, the pumping space 26 is tight except for the connector 24. The screw 30 is screwed into an internal thread 33 in the cylindrical extension of the plunger 22 by means of an external thread 32 and thus keeps the plunger 22 in position. The steel spring 28 is compressed and/or tensioned between the plunger 22 and the side (the base surface) of the hollow cylinder 20 having the feed-through for the screw 30 (the side is drawn on the left side of the hollow cylinder 20 in FIGS. 1 to 3). Accordingly, the steel spring 28 is used as compression spring 28. The tension of the compression spring 28 stores an amount of energy that is sufficient for evacuating the internal space of the cartridge 4, the vacuum conduit 12, and the liquid conduit 14 by means of the pump 18 and for drawing the monomer liquid from the liquid container 2 through the liquid conduit 14 into the internal space of the cartridge 4.

A projection 34 in the form of a pin 34 is arranged on the side of the plunger 22 that is opposite from the screw 28 and can exit from the hollow cylinder 20 through an opening 36 in the base surface of the hollow cylinder 20 that is situated opposite from the base surface having the feed-through for the screw 30. When the pin 34 projects through the opening 36, it can be recognised directly from outside that the pump 18 has triggered and the pumping process completed.

A glass ampoule 40 having a breakable head 42 is arranged in the liquid container 2. The glass ampoule 40 contains the monomer liquid. The head 42 of the glass ampoule 40 can be broken off or sheared off by rotating a rotating lever 44. The rotating lever 44 thus opens the connection and thus establishes a connection between the monomer liquid and the liquid conduit 14. In addition, a valve element (not shown) that can be opened by the rotating lever 44 can also be provided at the inlet of the liquid container 2 into the liquid conduit 14. The liquid container 2 is closed in gas-tight and pressure-tight manner by a lid 46 after the glass ampoule 40 has been inserted into the liquid container 2. After breaking the glass ampoule 40 open, the monomer liquid in the liquid container is available and can be guided through the liquid conduit 14 into the internal space of the cartridge 4 by using a negative pressure in the internal space of the cartridge 4 to aspirate the monomer liquid from the liquid container 2 into the internal space of the cartridge 4. The monomer liquid can then be mixed with the cement powder in the internal space of the cartridge 4 by means of the mixing device in a vacuum and/or at a negative pressure in order to generate the bone cement and/or a bone cement paste.

According to the invention, the vacuum mixing system is characterised by the following procedure. The pump 18 is triggered by rotating the screw 30 by its external thread 28 out of the internal thread 33 of the plunger 22. This is done once the cartridge 4 is made ready for use by inserting the sealing plunger 10, as is shown in FIG. 2. After the screw 30 is undone, the energy of the compressed steel spring 28 is released and the plunger 22 is accelerated in the direction of the opening 36. This motion enlarges the pumping space 26. As a result, the pressure in the pumping space 26 is reduced. Gas flows from the vacuum conduit 12, the internal space of the cartridge 4, and the liquid conduit 14 into the pumping space. The internal space of the cartridge 4 is thus being evacuated.

The plunger 22 is accelerated up to the end of the hollow cylinder 20 (on the right in FIGS. 1 to 3) until the pin 34 projects from the opening 36. This arrangement is shown in FIG. 3. The increase in the volume of the pumping space 26 must be sufficient to evacuate the gas from the vacuum conduit 12, the internal space of the cartridge 4, and the liquid conduit 14 and to draw the monomer liquid from the liquid container 2 into the internal space of the cartridge 4. For this purpose, the expanded pumping space 26, as shown in FIG. 3, is preferred to be larger than the volumes of the conduits 12, 14 of the internal space of the cartridge 4 and the liquid volume of the monomer liquid. It should be noted in this context that FIGS. 1 to 3 show the size relationships of the pumping space 26 and other volumes only schematically.

Once the starting components have been mixed in the internal space of the cartridge 4, the mixing tube 8 is pulled upwards out of the internal space of the cartridge 4 as far as it will go and can then be broken off at a predetermined breakage site. The sealing plunger 10 is rotated with respect to the sterilisation plunger 9 and thus the gas feed-through through the sealing plunger 10 is closed. The vacuum conduit 12 is then pulled off the sealing plunger 10. The cartridge 4 is unscrewed from the foot part 3 and a dispensing tube (not shown), by means of which the mixed bone cement can be applied, is screwed into the internal thread. The conveying plunger or dispensing plunger composed of the sterilisation plunger 9 and the sealing plunger 10 is unlocked and can be driven into the inside of the cartridge 4 by means of an application device (not shown). As a result, the content of the cartridge 4, i.e. the bone cement mixed at a negative pressure, is extruded from the opposite opening and through the screwed-on dispensing tube.

Except for the glass ampoule 40 and the steel spring 28 and the starting components of the bone cement, the components of the vacuum mixing system can be manufactured from a plastic material by means of injection moulding. The conduits 12, 14 can consist of a different plastic material. The vacuum conduit 12 must be flexible in order to be able to arrange the sealing plunger 10 on the mixing tube 8 such as to be mobile.

Except for the head of the screw 30, the conduits 12, 14 and the pump 18 are arranged in a housing made of plastic material that comprises a level bottom such that the vacuum mixing system can be set up on a level support.

Using the vacuum mixing system described above, the two starting components of the bone cement can be stored and mixed in a vacuum at any later point in time. The vacuum mixing system does not need to be connected to any external supply (power, water or compressed gas) in this context. The energy required to generate the negative pressure is stored in the tensioned steel spring 28 serving as energy reservoir. As an alternative to the compression spring 28, a tensioned tension spring that is tensioned, for pulling, between the opening 36 and the plunger 22 in the internal space of the hollow cylinder 20 could be used just as well or a tensioned gas spring could be used. However, the design involving a steel spring 28, in particular involving a compression spring 28, is simpler and less expensive.

Figure 4:
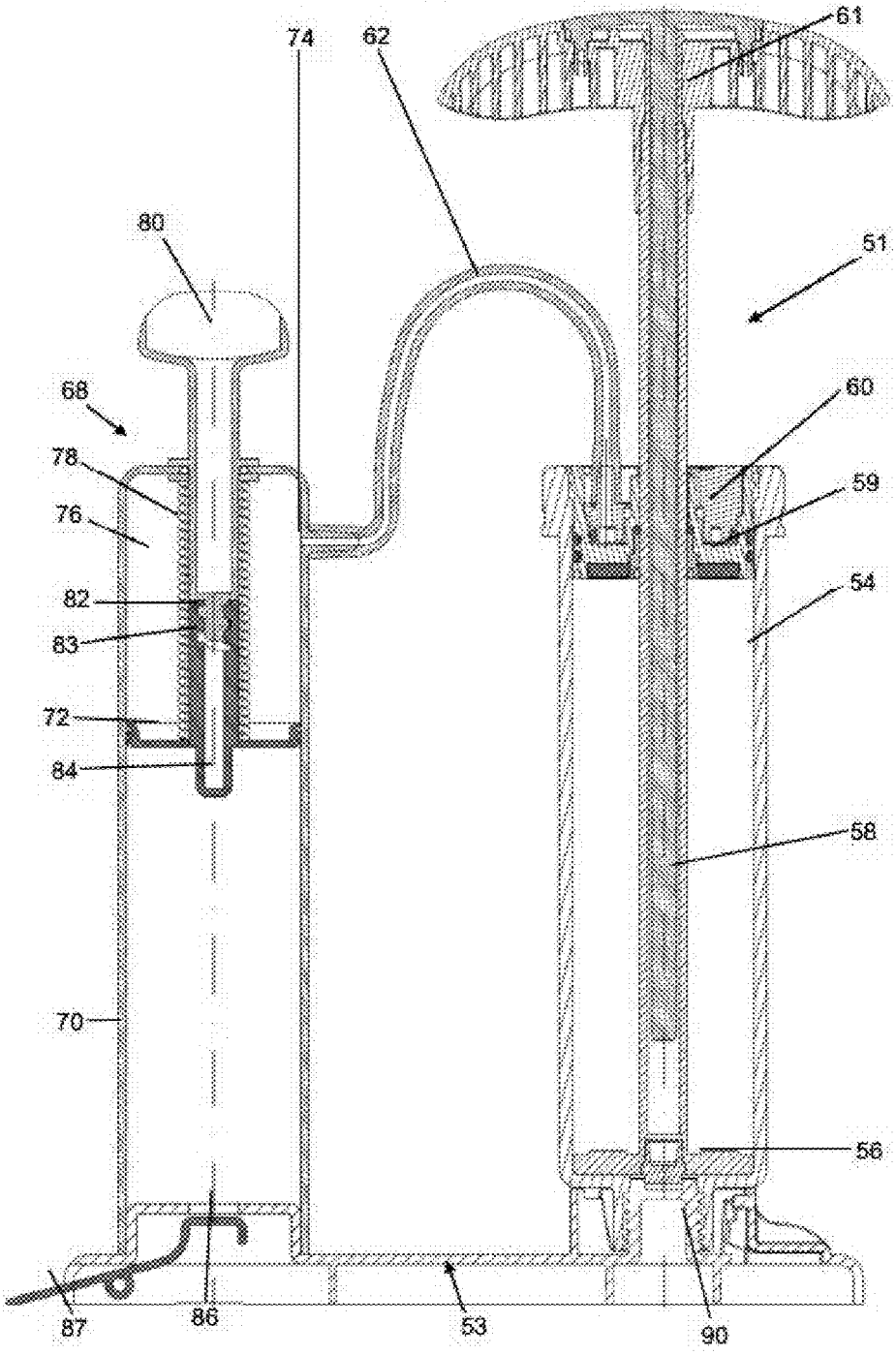
FIG. 4: shows schematic cross-sectional view of a further alternative vacuum mixing system according to the invention.

FIG. 4 shows a schematic cross-sectional view of another vacuum mixing system according to the invention having a simplified design. The vacuum mixing system comprises a cartridge system 51 that is screwed onto a base 53. The cartridge system 51 comprises a cartridge 54 having a cylindrical internal space. The internal space of the cartridge 54 is closed on the front side (on the bottom in FIG. 4), whereby the front dispensing opening comprises an internal thread and the cartridge 54 is screwed, by the internal thread, onto an external thread on the base 53.

Mixing vanes 56 of a mixing device are arranged in the internal space on a mixing tube 58 that is mobile in longitudinal direction and axially rotatable in the internal space of the cartridge 54. For this purpose, the mixing tube 58 is guided through a two-part dispensing plunger 59, 60 that consists of a sterilisation plunger 59 and a sealing plunger 60. The function of the two dispensing plunger parts 59, 60 is equivalent to the function of the dispensing part plungers 9, 10 according to the first exemplary embodiment. The mixing tube 58 ends at a handle part 61 by means of which the mixing device can be operated from outside the cartridge 54.

In contrast to the embodiment according to FIGS. 1 to 3, the present embodiment has no liquid conduit that would need to merge into the cartridge 54 in the connecting region (on the bottom in FIG. 4). In the embodiment according to FIG. 4, all components of the bone cement are simply filled in on the rear side of the cartridge 54 into the internal space of the cartridge 54 (on the top in FIG. 4). For this purpose, the two plunger parts 59, 60 are initially detached from the cartridge 54. After the starting components are filled in, the sterilisation plunger 59 is inserted first, then the content is sterilised briefly (the sterilisation plunger 59 is permeable for ethylene dioxide for this purpose), and then the sealing plunger 60 with a flexible connecting conduit 62 and/or vacuum conduit 62 connected to it is inserted into the sterilisation plunger 59 and connected to same by means of a snap-in locking mechanism. Inserting the sealing plunger 60 seals the internal space of the cartridge 54 with respect to the outside, except for the connector for the vacuum conduit 62, in gas-tight and pressure-tight manner.

The vacuum conduit 62 is connected to a pump 68 that is designed to include a hollow cylinder 70, regions of which are open on one side (opened on the bottom in FIG. 4), that is connected perpendicularly to the base 53. Moreover, the pump 68 comprises a plunger 72, which, in a non-locked state (not shown in FIG. 4), is axially mobile in the hollow cylinder 70 and subdivides the internal space of the hollow cylinder 70 into two parts that are gas-tight and pressure-tight with respect to each other. The vacuum conduit 62 merges, via a connector 74, in a pumping space 76 that is closed off towards the outside in a gas-tight and pressure-tight manner. A tensioned compression spring 78 is arranged in the pumping space 76 between the plunger 72 and the upper ceiling base surface of the hollow cylinder 70 (on the top in FIG. 4) and pushes the plunger 72 in the direction of the base surface of the hollow cylinder 70 facing the base 53. The reason for the plunger 72 not moving in the locked state under the effect of the compression spring 78 is that the plunger 72 is secured by means of a screw 80 that can be manually operated from outside. For this purpose, the screw 80 comprises an external thread 82 that engages an internal thread 83 in an axial tube section of the plunger 72 and thus keeps the same in position. The screw 80 is guided through the upper ceiling surface of the hollow cylinder 70 such as to be gas-tight and pressure-tight and rotatable. Rotating the screw 80 allows the screw to be detached from the plunger 72 and triggers the pump 68. Accordingly, the screw 80 serves as manual operating element for releasing the energy from the compression spring 78 which serves as energy reservoir.

The compression spring 78 accelerates the unlocked and/or detached plunger 72 in the direction of the base 53. While the air escapes from the part of the internal space of the hollow cylinder 70 facing the base 53 through an opening 86, the pressure in the expanding pumping space 76 decreases. As a result, gases are evacuated from the vacuum conduit 62 and through the vacuum conduit 62 from the internal space of the cartridge 54. The compression spring 78 pushes the plunger 72 against the base surface of the hollow cylinder 70 facing the base 53. In this context, a projection 84 on the side of the plunger 72 facing the base 53 is pushed through the opening 86 and, in this location, tips a rocker lever 87. Due to the motion and the position of the rocker lever 87, it can be recognised from outside whether or not the pump 68 has completed the pumping process. The increase in the volume of the pumping space 76 due to the pumping process is sufficient to generate a sufficient vacuum in the internal space of the cartridge 54. A vacuum can be sufficient already, if the pressure in the internal space of the cartridge 54 is reduced by at least 50%, though preferably it is reduced by at least 90%.

After the internal space of the cartridge 54 has been evacuated, the starting components filled into it can be mixed by means of the mixing device by moving the mixing tube 58 with the handle 61. Subsequently, the sealing plunger 60 is rotated against the sterilisation plunger 59 and the gas feed-through is thus closed by the sealing plunger 60. The vacuum conduit 62 is pulled off and/or removed from the sealing plunger 60. The cartridge 54 is unscrewed from the base 53 and a dispensing tube (not shown), by means of which the mixed bone cement can be applied from the cartridge 54, is screwed into the internal thread. The dispensing plunger 59, 60, which is composed of the sterilisation plunger 59 and the sealing plunger 60, is unlocked and can be driven into the inside of the cartridge 54 by means of an application device, i.e. a common extrusion device (not shown). By this means, the content of the cartridge 54, i.e. the bone cement mixed at negative pressure, is extruded from the opposite opening and through the dispensing tube screwed onto it.

Except for the starting components of the bone cement, the components of the vacuum mixing system can be manufactured by injection moulding of a plastic material. However, the compression spring 78 is also preferred to consist of steel. The vacuum conduit 62 can consist of a different plastic material. The vacuum conduit 62 must be flexible in order to be able to arrange the sealing plunger 60 in mobile manner on the mixing tube 58.

There is no need to connect the vacuum mixing system to any external supply (power, water or compressed gas) to be fully functional. As a result, the vacuum mixing system is less disruptive than conventional vacuum mixing systems and can always be used in mobile applications. The energy needed to generate the negative pressure and/or vacuum is stored in the tensioned compression spring 78 as energy reservoir that can be triggered easily by operating the screw 80. As an alternative to the compression spring 78, a tensioned tension spring or a tensioned gas spring can be used just as well. The design involving a compression spring 78 made of steel is simpler and less expensive and therefore preferred The features of the invention disclosed in the preceding description and in the claims, figures, and exemplary embodiments, can be essential for the implementation of the various embodiments of the invention both alone and in any combination.

LIST OF REFERENCE NUMBERS

1, 51 Cartridge system
2 Liquid container
3 Foot part
4, 54 Cartridge
6, 56 Mixing vane
8, 58 Mixing tube
9, 59 Sterilisation plunger
10, 60 Sealing plunger
11, 61 Handle part
12, 62 Connecting conduit/vacuum conduit
14 Liquid conduit
16 Siphon
18, 68 Pump
20, 70 Hollow cylinder
22, 72 Plunger
24, 74 Exit/connector
26, 76 Pumping space
28, 78 Spring
30, 80 Connecting element/screw
32, 82 External thread
33, 83 Internal thread
34, 84 Projection/pin
36, 86 Opening
40 Glass ampoule
42 Head of the glass ampoule
44 Rotating lever
46 Lid
53 Base
87 Rocker lever
90 Thread attachment

The invention claimed is:

1. Vacuum mixing system for the mixing of polymethylmethacrylate bone cement, comprising at least one cartridge (4, 54) having an evacuable internal space for mixing of the bone cement, a pump (18, 68) for generating a negative pressure, and a connecting conduit (12, 62) connecting the internal space of the at least one cartridge (4, 54) to the pump (18, 68) for generating a negative pressure, wherein the vacuum mixing system comprises an integrated energy reservoir (28, 78) for driving the pump (18, 68) that is or can be connected to the pump (18, 68) and has energy for at least one pumping process of the pump (18, 68) stored in it, whereby a negative pressure can be generated by means of the pump (18, 68) during said at least one pumping process by consuming energy from the integrated energy reservoir (28, 78) such that the negative pressure can be used to evacuate gas from the internal space of the at least one cartridge (4, 54) through the connecting conduit (12, 62), wherein said integrated energy reservoir (28, 78) is a tensioned restoring element (28, 78).

2. Vacuum mixing system according to claim 1, wherein the pump (18, 68) comprises a gas-tight pumping space (26, 76) and a mobile plunger (22, 72) or a mobile wall is provided in the pump (18, 68) to serve as boundary of the pumping space (26, 76), whereby the plunger (22, 72) or wall can be driven in one direction by the energy of the integrated energy reservoir (28, 78) such that the motion of the plunger (22, 72) or wall enlarges the pumping space (26, 76) and the negative pressure thus arising in the pumping space (26, 76) allows the internal space of the at least one cartridge (4, 54) to be evacuated through the connecting conduit (12, 62).

3. Vacuum mixing system according to claim 2, wherein said enlargement of the pumping space (26, 76) is by a volume that is at least equal to the free volume of the internal space of the cartridge (4, 54).

4. Vacuum mixing system according to claim 1, wherein the vacuum mixing system comprises a mixing device for the mixing of the content of the at least one cartridge (4, 54), whereby the mixing device is arranged in the internal space of the cartridge (4, 54) and/or can be driven manually or through a motor.

5. Vacuum mixing system according to claim 1, wherein said vacuum mixing system has a total weight that is less than 30 kg.

6. Vacuum mixing system according to claim 1, wherein the vacuum mixing system comprises a manually-operable operating element (30, 80) that can be operated to release the energy from the energy reservoir (28, 78), whereby the released energy drives the pump (18, 68) and the driven pump (18, 68) evacuates the internal space of the cartridge (4, 54).

7. Vacuum mixing system according to claim 1, wherein a mobile dispensing plunger (9, 10, 59, 60) for dispensing the mixed bone cement from the cartridge (4, 54) is arranged in the internal space of the cartridge (4, 54), whereby the dispensing plunger (9, 10, 59, 60) is or can be locked in place in detachable manner in order to prevent the dispensing plunger (9, 10, 59, 60) from moving in response to the effect of the negative pressure.

8. Vacuum mixing system according to claim 1, wherein an expansion or contraction of the tensioned restoring element (28, 78) generates a negative pressure in the internal space of the cartridge (4, 54).

9. Vacuum mixing system according to claim 1, wherein the cartridge (4, 54) is a cement cartridge (4, 54) filled with cement powder and the vacuum mixing system comprises a container (2) that is separate from the cement cartridge (4, 54) and contains a monomer liquid, whereby the container (2) is connected, in liquid-impermeable manner, to the internal space of the cement cartridge (4, 54) through a separating element (44) that can be opened, and the internal space of the cement cartridge (4, 54) is or can be connected to the pump (18, 68) in gas-permeable manner.

10. Vacuum mixing system according to claim 1, wherein the pump (18, 68) comprises a hollow cylinder (20, 70), whereby the hollow cylinder (20, 70) is or can be connected to the internal space of the cartridge (4, 54); a gas-tight closure on one end of the hollow cylinder; a plunger (22, 72) that is arranged in the hollow cylinder (20, 70) such as to be gas-tight and axially mobile; said tensioned restoring element is a spring (28, 78) that is arranged between the plunger (22, 72) and the closure; a connecting element (30, 80) that is connected, in detachable manner, to the plunger (22, 72) and keeps the plunger (22, 72) in position in the hollow cylinder (20, 70) and keeps the spring (28, 78) tensioned or compressed, whereby the connecting element (30, 80) is guided out of the hollow cylinder (20, 70) through a gas-tight feed-through and can be detached from the plunger (22, 72) from outside, whereby, after detaching the connection of the connecting element (30, 80), the plunger (22, 72) can be moved axially opposite to the closure by the expansion of the spring (28, 78).

11. Vacuum mixing system according to claim 10, wherein said spring (28, 78) is compressed in the storage state and is kept in the compressed state by the plunger (22, 72) of the pump (18, 68) by means of the locked connecting element (30, 80).

12. Vacuum mixing system according to claim 10 wherein the plunger (22, 72) is shifted inside the hollow cylinder (20, 70) after expansion of said spring (28, 78) such that the volume of the pumping space (26, 76) formed by the hollow cylinder (20, 70), the closure, and the plunger (22, 72) is at least equal to the volume of the internal space of the cartridge (4, 54) to be evacuated.

13. Vacuum mixing system according to claim 10, wherein a boundary element is arranged on the end of the hollow cylinder (20, 70) and limits the motion of the plunger (22, 72) such that the plunger cannot exit from the hollow cylinder (20, 70).

14. Vacuum mixing system according to claim 10, wherein the plunger (22, 72) contains, on the side facing away from the closure, an optical marker (34, 87) that can be recognized visually on the outside of the vacuum mixing system after a maximal motion of the plunger (22, 72) took place and thus indicates the position of the plunger (22, 72) after its maximal motion.

15. Method for the mixing of polymethylmethacrylate bone cement in an internal space of a cartridge (4, 54) of a vacuum mixing system according to claim 1, wherein energy stored in the tensioned restoring element (28, 78) that is integrated into the vacuum mixing system is used to drive a pump (18, 68) of the vacuum mixing system, whereby the pump (18, 68) thus driven is used to evacuate the internal space of the cartridge (4, 54) and to mix a bone cement in the internal space of the cartridge (4, 54).

16. Method according to claim 15, wherein the volume of a pumping space (26, 76) of the pump (18, 68) is enlarged by relaxation of the tensioned restoring element (28, 78), and the internal space of the cartridge (4, 54) is evacuated by the negative pressure thus generated.

17. Method according to claim 15, wherein the internal space of the cartridge (4, 54) contains a cement powder, and the pump (18, 68) evacuates a gas from the internal space of the cartridge (4, 54), a monomer liquid is guided into the internal space of the cartridge (4, 54), and the monomer liquid is mixed with the cement powder in the evacuated internal space of the cartridge (4, 54).

18. Method according to claim 15, wherein a connecting element (30, 80) is detached from a plunger (22, 72) of the pump (18, 68); followed by said tensioned restoring element (28, 78) moving the plunger (22, 72) axially in a hollow cylinder (20, 70) of the pump (18, 68), by means of which a negative pressure is generated; whereby gas is aspirated from the internal space of the cartridge (4, 54) through a connecting conduit (12, 62) into the hollow cylinder (20, 70); followed by a cement powder being mixed, manually or motor-driven, with a monomer liquid by means of a mixing device (6, 56); followed by the cartridge (4, 54) with the mixed cement dough being removed; and the cement dough being extruded from the cartridge (4, 54) by moving a dispensing plunger axially (9, 10, 59, 60).

19. Method according to claim 15, wherein the cement powder is arranged in the cartridge (4, 54);

the monomer liquid is arranged in a container (2) that is separate from the cartridge (4, 54), whereby the monomer liquid is separated from the cement powder in the cartridge (4, 54) by means of a separating element (44);

the separating element (44) is opened before the connecting element (30, 80) is detached from the plunger (22, 72) such that a liquid-permeable connection is established between the internal space of the cartridge (4, 54) and the container (2); followed by the tensioned restoring element (28, 78) moving the plunger (22, 72) axially in the hollow cylinder (20, 70), whereby a negative pressure is generated; whereby gas is aspirated from the internal space of the cartridge (4, 54) through the connecting conduit (12, 62) into the hollow cylinder (20, 70), and monomer liquid is aspirated into the cartridge (4, 54) through the negative pressure formed in the internal space of the cartridge (4, 54).

* * * * *